United States Patent [19]

Jaunin

[11] 4,223,525

[45] Sep. 23, 1980

[54] SEQUENTIAL DISPLAY FOR DIGITAL CHRONOGRAPH

[75] Inventor: Jean-Pierre Jaunin, La Neuveville, Switzerland

[73] Assignee: Societe Suisse pour l'Industrie Horlogere Management Services, S.A., Bienne, Switzerland

[21] Appl. No.: 950,353

[22] Filed: Oct. 11, 1978

[51] Int. Cl.[3] ..... G04F 8/00; G04B 19/30; G04F 7/04

[52] U.S. Cl. ..... 368/113; 368/82; 368/101

[58] Field of Search ..... 58/50 R, 74, 39.5, 75

[56] References Cited

U.S. PATENT DOCUMENTS

| | | | |
|---|---|---|---|
| 4,044,546 | 8/1977 | Kolke | 58/50 R |
| 4,084,402 | 4/1978 | Moyer | 58/50 R |
| 4,089,156 | 5/1978 | Kashio | 58/50 R |
| 4,110,966 | 9/1978 | Kashio | 58/4 A |

*Primary Examiner*—Vit W. Miska

*Attorney, Agent, or Firm*—Griffin, Branigan & Butler

[57] ABSTRACT

A timepiece having chronograph features has an electronic digital display capable of displaying six digits. In the chronograph operating mode these are normally minutes, seconds and hundredths of seconds. Should the instrument run for more than one hour prior to a stop or split operation, then during such operation a detector and a timer will cause hours alone to be displayed alternating with the remaining information (minutes, seconds, hundredths of seconds). Thus a six digit display may be employed for eight digit information.

9 Claims, 2 Drawing Figures

1
2
2
2
2
2A
2A
2A
2A
9
8
10
1 SEC.
1/100
0-59 SEC.
0-59 MIN.
0-12 OR 0-24 HRS
1/100
1 SEC.
1 MIN.
1 HR
START
STOP
RESET
0-99 HR.
0-59 MIN.
0-59 SEC.
0-99/100 SEC.
5
4
3
LATCH DECODE DRIVER
DISPLAY
6
DISPLAY CONTROL LOGIC
7
SET
RESET

A
B
C
D

SEQUENTIAL DISPLAY FOR DIGITAL CHRONOGRAPH

BACKGROUND OF THE INVENTION

In modern digital display electronic timepieces costs of production will be linked to the number of digits which it is required to display at any one time. For ordinary timekeeping instruments such as wristwatches six digits will ordinarily suffice and will display hours, minutes and seconds. Should, however, the instrument be further intended to be utilized as a time measuring instrument such as a chronograph more digits may be required and it may be desired to display as well as seconds, hundredths of seconds. Thus a full chronograph display might show in the right hand columns digits indicating from 0 to 99 hundredths of a second, in the next adjacent columns from 0 to 59 seconds, in the next adjacent columns from 0 to 59 minutes and in the left most columns from 0 to 99 hours. This arrangement will obviously require 8 digit columns and for such reason costs will be increased. Where no hours accumulation takes place it will still be possible to limit the display to 6 digit columns. This however renders the instrument somewhat less useful in practice.

To overcome this difficulty it has been suggested to shift the digits alternately between a display of hours, minutes, seconds and a display of minutes, seconds and hundredths of seconds. This, in turn, however, renders the instrument more difficult to use since at any given time the user may be unaware of what is actually displayed.

The present invention provides a solution to this problem which avoids such difficulty to the user and at the same time enables the instrument to be manufactured using only six digit columns thereby reducing its cost of manufacture. The arrangement is such that as long as no hours have been accumulated the display will continuously read out minutes, seconds and hundredths of seconds. In the event that there should be carry over from the minutes accumulator into an hours accumulator indicating that the elapsed time has exceeded one hour, then upon stopping the instrument for reading either following the termination of an event or during reading for lap and split timing there will be an alternating sequence display, one element of the sequence consisting of hours alone displayed in the left most digit columns with the remaining digits being blanked out and the other element of the sequence consisting of the normal display of minutes, seconds and hundredths of seconds. In order to enhance the effect for the user the hours display may be timed to a period which is shorter than that for the minutes, seconds and hundredths of seconds.

SUMMARY OF THE INVENTION

In accordance with the foregoing the invention therefore provides a timepiece having an electronic digital display of predetermined digit capacity, means for detecting when said predetermined capacity has been exceeded by overflow information and means responsive to said detecting means for connecting the display in an alternating sequence to the information normally present and to the overflow information.

DETAILED DESCRIPTION OF THE INVENTION

Figures 1, 2:
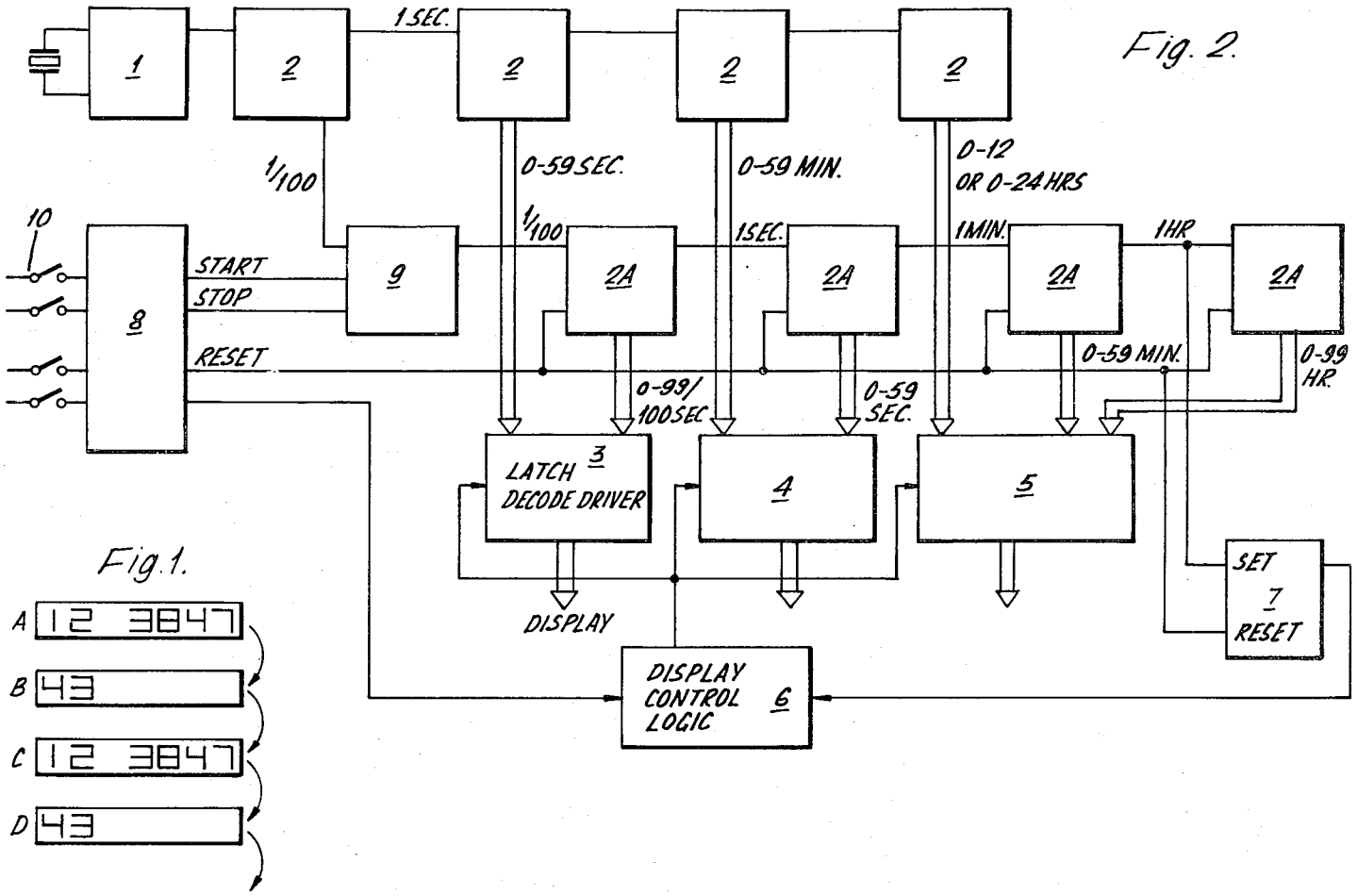
FIG. 1 shows the display lay-out and how it would perform in the alternating sequence.
FIG. 2 is a basic logic diagramme showing how the invention might be accomplished in a typical example.

In FIG. 1 four display sequences are shown as they might appear on the actual face of the instrument. Thus A shows a display of 12 minutes 38 seconds and 47 hundredths of a second. This display may in a typical example last during 4 seconds. In B only the digits 43 appear in the left hand columns. This display is intended to replace display A and since only 2 digits are displayed the user may read these as hours. The display thus is of 43 hours and such display may be continued during a period of for example 2 seconds. Following this, display A is repeated for 4 seconds and followed by display B again for 2 seconds. Thus, the user upon stopping for any particular purpose the running of the instrument may easily read off 43 hours, 12 minutes, 38 seconds and 47 hundredths of a second.

In FIG. 2 1 represents an oscillator controlled by a quartz crystal as is common in modern instruments of this type. 2 represents a multistage frequency divider from which outputs may be taken at various stages. Blocks 3, 4 and 5 represent decoder-driver latches for controlling the outputs to the various display columns. Block 6 contains the control logic for the display and block 8 contains the logic associated with the varioius user accessible control switches. The display itself may take any one of several well-known forms including liquid crystal displays or light emitting diodes. Each of these several elements is in itself well-known to those skilled in the art of timekeeping instruments whereby it is considered unnecessary to give full descriptions thereof. Block 7 comprises a set-reset-flip-flop the function of which will become apparent as the description proceeds.

Four user accessible control switches 10 are shown, one of which may be employed to select the mode of operation, i.e. timekeeping mode or chronograph mode. The functions of the other switches will depend on the mode in which the instrument is operating, but since the present description is concerned with a chronograph, their further functions will not be described. Thus, in the chronograph mode one switch will start the instrument running, the second switch will stop the instrument from running in order to permit display read-out either at the end of an event or for split or lap timing and a third such switch will provide a reset signal to the various control elements.

Owing to the fact that in an instrument of this type normally the timekeeping information will be genrated as well as time measuring information it is necessary to provide supplemental divider stages whereby it will be possible to generate signals representing hundredths and tenths of a second and from these to develop further signals representing seconds, minutes and hours. The supplemental stages have been designated as 2A. When operating in the timekeeping mode the normal display will consist of the usual seconds, minutes and hours and for this reason connexions have been shown from the stages 2 of the regular frequency divider to the several decoder driver latches 3, 4 and 5 respectively. When the instrument is switched to operate in the chronograph mode divider stages 2A will be connected to the respective decoder driver latches 3, 4 and 5.

When a chronograph start signal is received hundredths of seconds signals will be transmitted from one of the stages of frequency divider 2 through block 9 to the first of several succeeding chronograph divider stages 2A including a stage which registers from 0 to 99 hundredths of a second, from 0 to 59 seconds and from 0 to 59 minutes. A final stage in chronograph dividers 2A will accumulate from 0 to 99 hours.

Until the instant when a carry over occurs from the minutes accumulator to the hours accumulator the display will be controlled from the logic block 6 to display outputs from the first three of these four stages as shown. Should the event being time exceed 1 hour then a signal will be transmitted to set the flip-flop 7 from which a signal will be applied to the logic control block 6. Thereafter, whenever a stop signal is applied by the user indicating the end of an event or the lap or split stop the signal output from block 6 will change and will have the effect of blanking out all information normally passing through decoder drivers 3 and 4 for a predetermined time period which may as previously indicated be of 2 seconds for example. At the same time inputs to decoder driver 5 are switched so that in place of the normal minutes input coming from block 2A in the chronograph frequency divider inputs are gated through from the hours accumulator. In a following sequence the hours will be caused to disappear and the normal display of hundredths of a second, seconds and minutes will appear on the display having been gated through the decoder driver latches 3, 4 and 5 in accordance with the normal running prior to the accumulation of hours signals.

As previously indicated a variable timing arrangement may be provided wherein hours are displayed for two seconds only while the remaining information is blanked out and thereafter the normal information of hundredths of a second, seconds and minutes is displayed for a 4 second period. Obviously, these durations of the respective display sequence may be varied to suit individual cases and if so desired may be made perfectly equal. Since the logic circuits necessary to accomplish such timing are well-known to those skilled in the art of digital electronic watch design it is considered unnecessary to go into the details of such a circuit.

Following reading and following completion of the event, all stages may be reset through application of a reset signal from one of the several user accessible switches as shown.

What we claim is:

1. A timepiece having an electronic digital display of predetermined display capacity, storing means for storing a quantity of display information exceeding said predetermined display capacity, detecting means for detecting the presence of overflow display information exceeding said predetermined display capacity and connecting means responsive to a signal from the detecting means indicating the presence of said overflow information for connecting the display in an alternating sequence to information normally present and to said overflow information.

2. A timepiece as set forth in claim 1 comprising a chronograph adapted to measure elapsed time wherein the information to be displayed includes hundredths of seconds, seconds, minutes and hours.

3. A timepiece as set forth in claim 1 wherein each type of information to be displayed requires one set of two digit columns in the display.

4. A timepiece as set forth in claim 3 wherein the display provides one set of columns fewer than the number required for displaying all of the stored information.

5. A timepiece as set forth in claim 2 wherein the display provides six digit columns.

6. A timepiece as set forth in claim 5 wherein is normally displayed minutes, seconds and hundredths of seconds.

7. A timepiece as set forth in claim 6 wherein is included an hours accumulator, detecting means arranged to generate a signal in response to the presence of information in said hours accumulator and switching means responsive to said signal and to a "stop" or "split" condition of the timepiece to connect in alternating sequence the hours information and the minutes, seconds and hundredths of seconds to the display.

8. A timepiece as set forth in claim 7 wherein a timing circuit is provided adapted to control the respective durations of display of the hours and of the minutes, seconds and hundredths of seconds.

9. A timepiece as set forth in claim 8 wherein the hours display is of shorter duration than the minutes, seconds and hundredths of seconds display.

* * * * *